US006145281A

United States Patent [19]

Hansen et al.

[11] Patent Number: 6,145,281

[45] Date of Patent: Nov. 14, 2000

[54] METHOD AND APPARATUS FOR PACKAGING A SERIES OF ARTICLES IN DIFFERENT FORMATIONS

[75] Inventors: Finn R. Hansen; Ole Petter Suxrud, both of Honefoss, Norway

[73] Assignee: Dalwell AB, Blackefors, Sweden

[21] Appl. No.: 09/187,720

[22] Filed: Nov. 5, 1998

Related U.S. Application Data

[63] Continuation-in-part of application No. PCT/SE97/00767, May 9, 1997.

[30] Foreign Application Priority Data

May 8, 1996 [SE] Sweden ..... 9601784

[51] Int. Cl.[7] ..... B65B 35/50; B65B 35/30

[52] U.S. Cl. ..... 53/447; 53/537; 53/544; 414/789.6

[58] Field of Search ..... 53/447, 446, 537, 53/540, 544, 531; 414/789.6, 789.8, 789, 789.4

[56] References Cited

U.S. PATENT DOCUMENTS 3,657,860 4/1972 Franklin ..... 53/537
3,802,154 4/1974 Dillon ..... 53/537
4,785,611 11/1988 Hasenbalg ..... 53/544

FOREIGN PATENT DOCUMENTS

0704386A1 4/1996 European Pat. Off. .
0744345A1 11/1996 European Pat. Off. .
1457624 12/1976 United Kingdom .

*Primary Examiner*—John Sipos
*Assistant Examiner*—Steven Jensen
*Attorney, Agent, or Firm*—Davis and Bujold

[57] ABSTRACT

The invention concerns a method and an apparatus (1) for packaging series of articles (3) in different formations (71). According to the invention, articles for each formation (71) are fed in mutually opposite directions (69, 70) by longitudinal conveyors (2) towards a common receiving zone (6) for collecting and stacking of articles (3), where first articles are stopped and transferred laterally by lateral conveyors (15) to a first collecting means (25) for collecting part of a stack (72) of two formations (71) of articles, whereupon a so collected part is released to a second collecting means (34) for collecting the remainder of a complete stack (72) by way of stopping and transferring second articles. The complete stack (72) is then moved onwards for further handling and packaging, and the latter movement is provided to be carried out during the first collecting step.

22 Claims, 8 Drawing Sheets

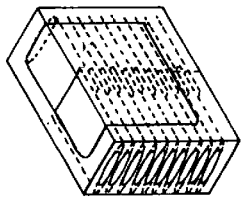
FIG.9A
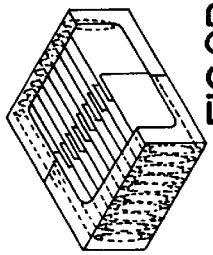
FIG.9B
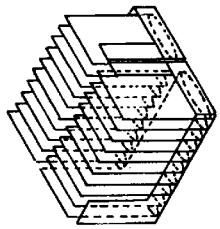
FIG.9C
FIG.1
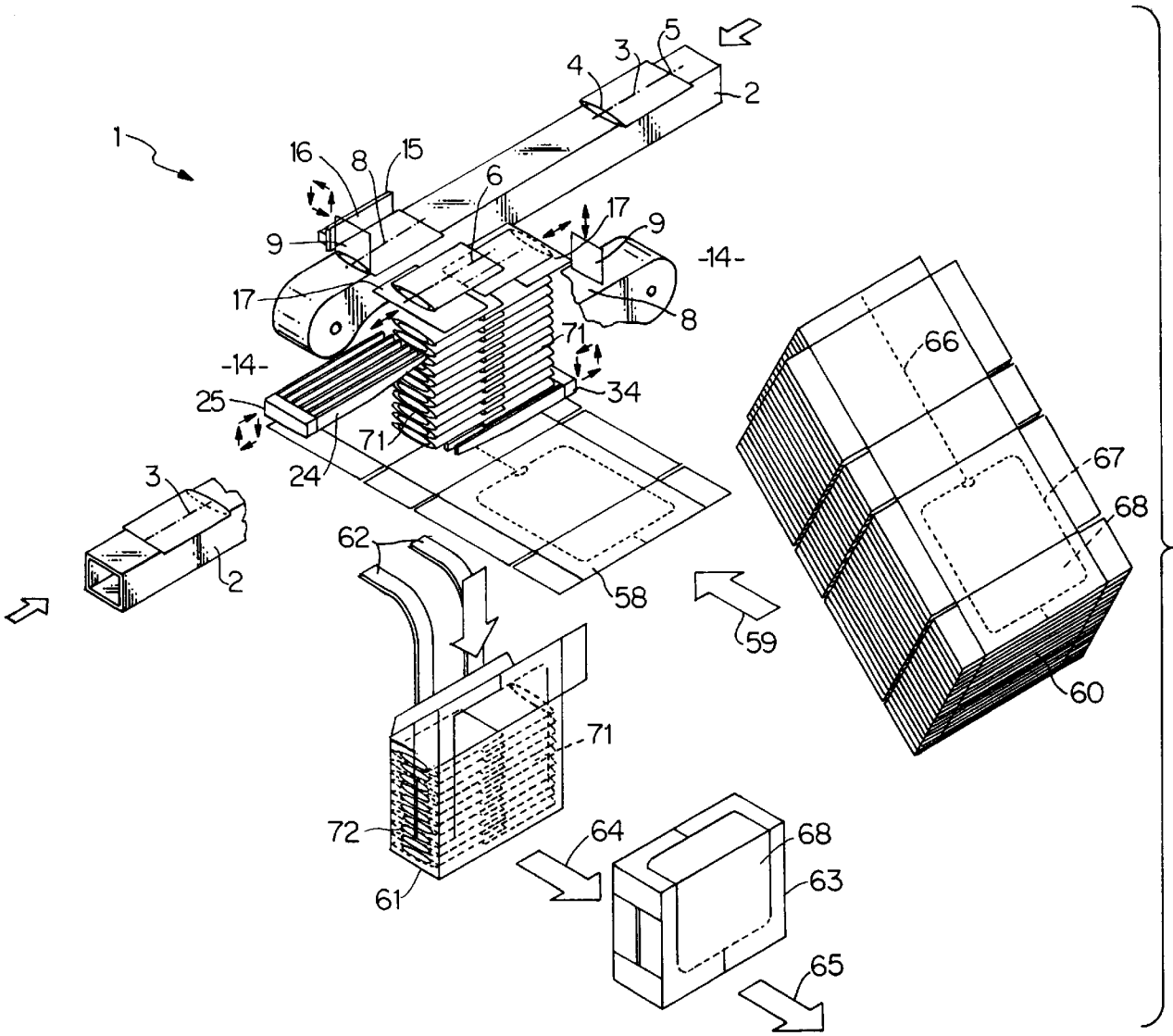

METHOD AND APPARATUS FOR PACKAGING A SERIES OF ARTICLES IN DIFFERENT FORMATIONS

This is a continuation-in-part application of International Application No. PCT/SE97/00767 filed May 9, 1997 and designating the United States of America.

FIELD OF THE INVENTION

The present invention relates to a method and apparatus for packaging a series of articles in different formations, and in particular but not exclusively, to the packaging of articles in a double stacked formation for purposes of efficiency, conservation of packaging material and ease of handling, display and use of the final packaged articles.

BACKGROUND OF THE INVENTION

This invention relates to the packaging of particularly bag-like articles containing e.g. instant soup ingredients, potato chips, instant tea and many other products. This invention relates not only to products belonging to the foodstuff sector, but to virtually any kind of product, not only bags and packages, but also boxes and any other shape of articles and/or wrappings. This invention generally contemplates the articles being packed into a formation consisting of two adjacent stacks, each article abutting and/or overlapping another article within an outer wrapping or package. The outer wrapping or package preferably being a carton which may be torn apart into two halves, each half separately holding one of the stacks of articles. The articles thus won't have to be rearranged upon opening the carton or the like, but are ready for immediate display, sale and use in this fashion.

A carton containing articles as described above is previously known by EP-A0 704 386. It will be appreciated, that this way of packaging saves a lot of space and thus packing material. As the end portions of the articles are in general very thin and the articles are formed into two stacks with these thin portions in each stack of articles facing and overlapping each other (FIG. 3), such overlapping does not affect the total extension of either formation in the stacking direction, as only the thinner portions of the articles overlap each other.

While such method of packaging generally is considered desirous and convenient as far as for instance, use of available volume and outer packing material, where transport, storage and display are concerned, little thought has been given so far to an advantageous mode of and apparatus for carrying out such packaging. A significant problem is the practical adaption to the need for continuous change of the direction in which the articles are to be stacked in two different kinds of formation, the counting and grouping of both single articles and formations and the transport of such formations to packaging. In particular, so far there is no packaging machine or any suggestion or solution which achieves both a reliable and high packing pace as well as safety of operation for such a method of packaging articles.

SUMMARY OF THE INVENTION

It is, therefore, an object of the present invention to provide a method and an apparatus for packaging a series of articles in different formations. It is furthermore a particular object of the present invention to provide means for high packing speeds and simultaneously improved safety and reliability of operation. It is, finally, an object of the present invention to improve known techniques in this field in various aspects.

These objects are achieved, according to the present invention, by the method of packaging comprising the steps of feeding a series of articles to be packaged to a receiving zone on mutually opposing sides of a common collection zone, the collection zone having a plurality of reciprocating collecting means, stopping and laterally transferring the articles from the receiving zones into the collection zone, positioning a number of the series of articles on one of the collecting means to form a stack of articles, packaging the stack; and concurrently with the packaging, positioning another number of the series of articles on another of the reciprocating collecting means.

These objects are also achieved, according to the present invention, by an apparatus comprising longitudinal conveyors feeding the series of articles to opposing sides of a common collection zone, lateral traversing means for stopping the longitudinal progress of and cyclically sweeping the articles from the conveyors into the collection zone, the collection zone having an plurality of reciprocating collecting means, each collecting means receiving and positioning a number of the series of articles in a stack; and a packaging and handling means for packaging the stacks of articles in cooperation with the collecting means wherein the packaging and handling means operates concurrently with the receiving and positioning of another number of the series of articles on another of the reciprocating collecting means.

BRIEF DESCRIPTION OF THE DRAWINGS

The present invention will now be described by way of example, by reference to the accompanying drawings, in which FIG. 1 shows a diagrammatic perspective view of a main part a first embodiment of the apparatus according to the present invention which also illustrates method features;

FIG. 9A, B and C show the final packaged formation of articles and subsequent methods of displaying the articles within the package.

DESCRIPTION OF THE PREFERRED EMBODIMENTS

Figure 2:
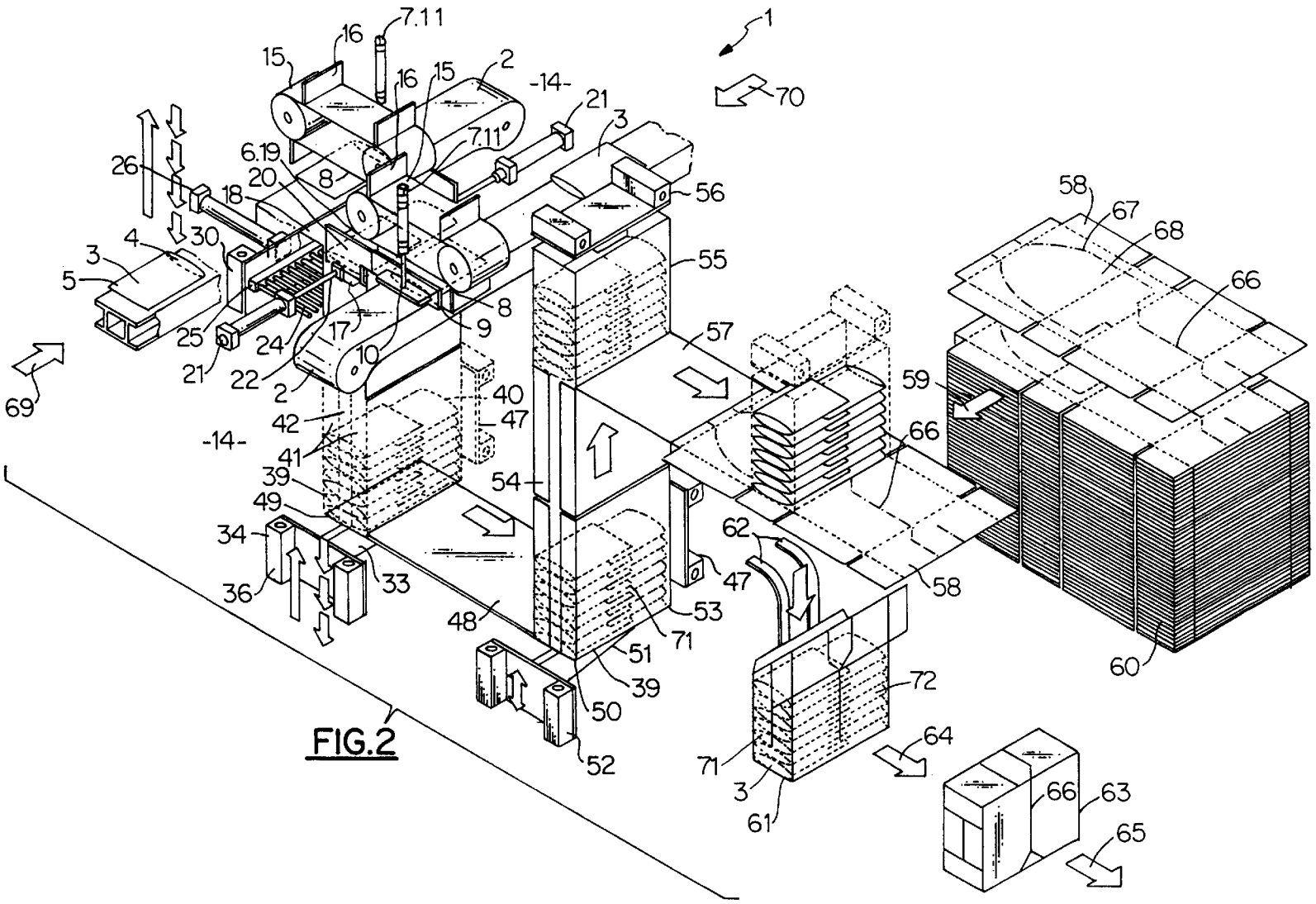
FIG. 2 shows a diagrammatic perspective view similar to FIG. 1 but in greater detail.
Figure 3:
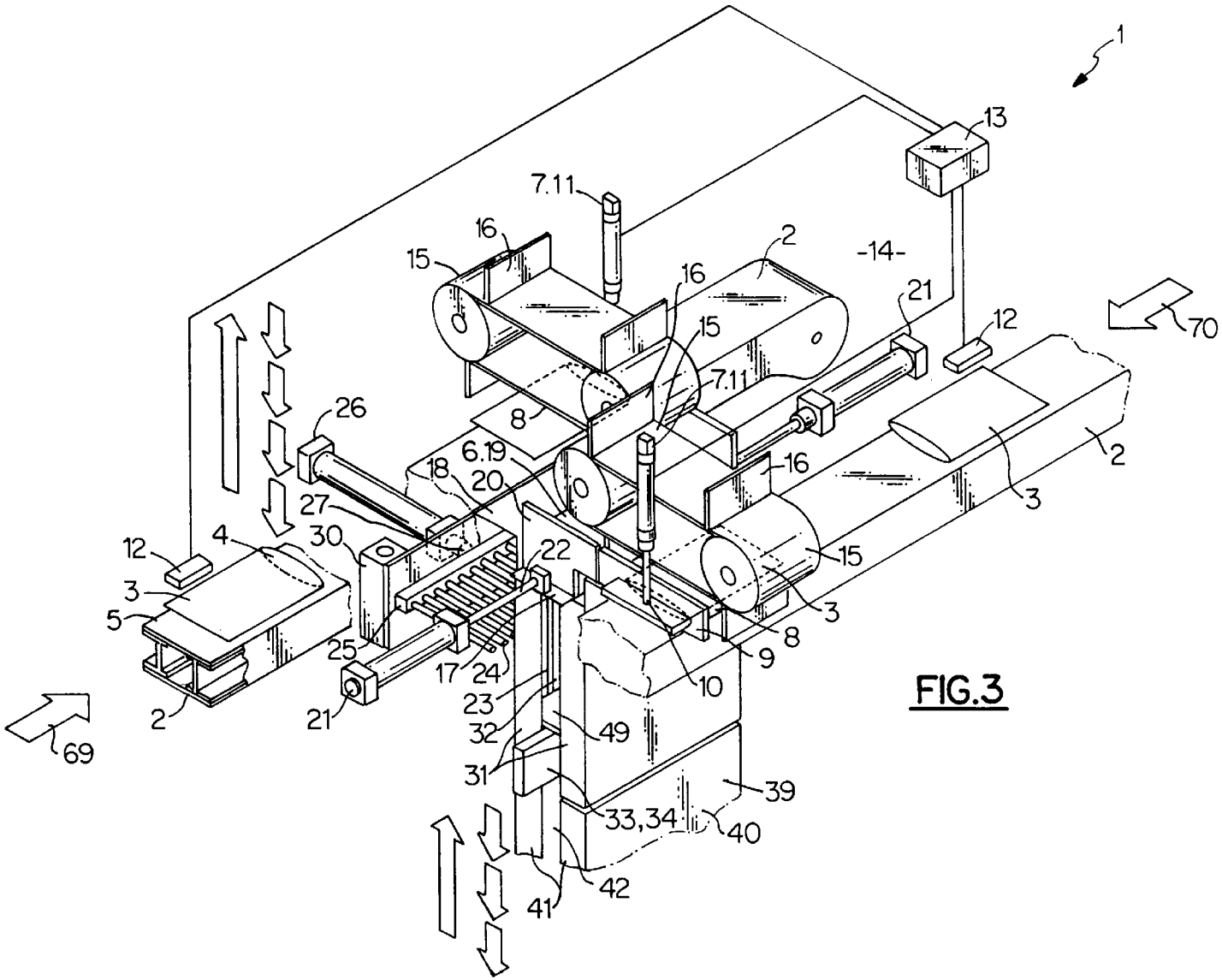
FIG. 3 is a magnified partial perspective view of part of FIG. 2.

In FIGS. 1, 2 and 3 of the drawings, the entire apparatus according to the present invention is designated by 1. It comprises two longitudinal conveyors 2, preferably endless belt conveyors, which are located on the same level, in parallel relation to but spaced apart from each other. Both longitudinal conveyors feed articles 3 with bottom ends 4 and top ends 5 towards opposing sides of a receiving zone 6 common to both longitudinal conveyors. A longitudinal conveyor 2 is provided for each alternate article of stack 71 of articles. As seen in FIG. 2 an actuating stop means 7 is located across each conveyor establishing a stop zone 8 for arresting articles.

Each actuating stop means 7 comprises a stop plate 9, which preferably is suspended from an actuating rod 10 forming part of a pneumatic cylinder 11. The exact position of each stop plate is adjustable in a way as is well known in the art, so that the length of travel of the articles on each conveyor and thereby the longitudinal distance between the planes of both stop plates can be adjusted, primarily for adaption to different sizes of articles to be handled. For certain special applications, the angles of each stop plate in a vertical and/or lateral direction may also be adjustable to deviate from the ordinary 90° in relation to the plane and axis of the longitudinal conveyor belt. As shown in FIG. 3, the actuating stop means 7 are linked to sensors 12, e.g. photo cells, associated with each conveyor and linked to a computer unit 13 for detecting any misfeed, either concerning the orientation of the articles in general or in relation to each other. In case of a misfeed, the actuating means of the conveyor in question will pull up its stop plate, so that the misfed articles(s) will pass across the stop zone 8 on the conveyor to a misfeed collecting zone 14.

In front of each stop plate 9, i.e. upstream on each longitudinal conveyor, there is provided at right angle across and above the latter, a lateral conveyor 15, preferably an endless belt conveyor, having carrier plates 16 as illustrated in FIG. 2. The lower part of these lateral conveyors moves towards the receiving zone 6 between the two longitudinal conveyors, whereby said carrier plates sweep or propel the articles, traveling on the longitudinal conveyor and arrested by said stop plates, in a lateral direction onto a horizontal receiving plate 17 interposed along each longitudinal conveyor and adjacent each stop zone 8.

Both receiving plates 17 are preferably located on the same level, which is slightly lower than the level of the upper part of the longitudinal conveyors. The difference between these two levels may correspond to the approximate maximum thickness of articles to be handled. Interposed between each longitudinal conveyor and the receiving plates 17, there are provided angled guide plates 18 each having two legs, one leg of which lies roughly within the same plane as said upper conveyor part, while the other leg is turned down. These legs define a generally vertical duct 19 having two sides and two ends about a longitudinal axis to contain collected and stacked articles. The width of said receiving plates 17 corresponds to somewhat less than the width of said duct, while the length of these plates, particularly if located on the same level, is roughly equal to or less than the length of each package. It is considered sufficient to have the plates carry part, e.g. 40–80%, of the length of the articles. Even a coverage of only 40% will retain a bag-like article on said plate, as the bottom part of the article is considerably thicker and heavier than the top part.

The lateral conveyors 15 are in parallel relation to and may overlap each other slightly. The carrier plates 16 extend perpendicular to the surface of the lateral conveyor belt and preferably amount to part of the length of the articles only, for instance 20–90%, more particularly approximately 60%.

Downstream of each receiving plate 17, there is arranged, roughly in a vertical plane transverse to the receiving plate, a positioning plate 20, the exact position which may, of course, be adjusted depending upon the article and the desired formation. In operation, the positioning plate 20 is stationary, while the receiving plate is movable. The receiving plate is withdrawn from an initial position in the receiving zone 6 in a direction downstream of the respective adjacent longitudinal conveyor and then back again to the initial position in the receiving zone 6. The movement is effected by a receiving plate actuator 21, e.g. a pneumatic cylinder with a rod 22 attached to the receiving plate in question. Each plate 17 may be withdrawn individually (i.e. as soon as an article has been dropped on to one of them) or both plates may be withdrawn simultaneously (i.e. as soon as an article has been dropped on to both of them) so that by such a simultaneous movement, two articles are released at a time, which is particularly applicable in case of a considerable overlap between two stacks of articles.

As set forth above the duct 19 is defined by said angled guide plates 18. The turned down leg of one guide plate defining one side of the duct does not however, cover the entire respective side in question, but is formed with vertical slates 23, between which the free ends of the horizontal bars 24 of an upper step lift 25, are insertable. This step lift is provided adjacent said duct on its one side and is movable, with its bars 24 forming a collecting means for receiving stacked articles, vertically and horizontally with respect to the duct by means of an upper step lift actuator 26, e.g. a pneumatic cylinder, with an actuating rod 27. Simultaneously with the receiving of articles, the upper step lift 25 is movable downwards, with the aid of an actuating means 30, in steps 37 from an upper level 28 to a lower level 29, each step corresponding roughly to the thickness of a received article. Apart from said steps 37, the upper step lift travels transversely in one engagement step 43 in the upper position into said duct and in one disengagement step 44 in the lower position out of said duct and, finally, in one big step 45 from the lower position up to an upper (standby) position preceding step 43.

The ends of the duct 19 are partially enclosed by angled continuations 31 of the turned down legs of the guide plates leaving a vertical slot 32 in the center of each end for a bearing arm 33 of a lower step lift 34, which can be lowered in steps 38 from an upper level coinciding with the lower level 29 of the upper step lift 25 down to a lower level 35 by means of an actuating means 36 incorporating e.g. a pneumatic cylinder (not shown). The steps 38 of the lower step lift are provided to continue from an upper position within said duct 19 downwards out of said duct and into a formation holder 39 roughly corresponding in form to that of the duct, i.e. with lateral sides 40, angled continuations 41 and a vertical slot 42 in the center of the ends. With the formation holder, there are, preferably, two uninterrupted lateral sides 40, as there is no need for any horizontal penetration. Apart from lowering steps 38, the lower step lift is displaceable from its lower level 35 up to its upper level 29 in one major single step 46 to its upper standby position.

While the duct 19, apart from any adjustability, is stationary, the said formation holder 39 is movable in a transverse direction away from both step lifts by means of a formation holder actuating means 47, whereby the formation holder passes over a sliding surface 48, which is located adjacent and between a platform 49 carried by said bearing arm 33 and a similar platform 50 carried by a second bearing arm 51, which belongs to an actuating means 52 of a transfer unit 53.

Above said unit 53, there is provided a stationary guide channel 54 of similar shape as the formation holder 39, above which channel 54 there is provided a last transfer means 55, which has a similar form as the formation holder 39, but may be closed all around apart from the bottom, which is provided to receive a double stack of articles, as indicated in the drawings.

The final transfer means 55 is suspended from a transfer actuating means 56, by means of which it is provided to travel above a second sliding surface 57, in a direction further away from both step lifts on to e.g. a carton blank 58 sized to accommodate a double stack of articles, and which is fed in position in the direction of an arrow 59 from a carton stack 60, e.g. with the aid of suction means (not shown) as is known in the art.

The carton blank and the double stack of articles with mutual overlap is then sucked down to a folding unit 61, only one side of which is shown in the drawings, the side consists of curving converging bars 62 bringing about automatic folding of the blank around the double stack along with other folding means, which are known per se and not shown here. A thus folded and sealed carton 63 of articles is completed and moved on to further handling in the direction of the arrows 64 and 65.

All ducts, transfer units, holders etc. may, of course, be designed adjustable and/or exchangeable for various sizes of articles. As shown in FIG. 9 the packages include, preferably, as known in the art, a central tear apart line 66 and a window line 67 surrounding a window 68. Firstly, the window is torn away and then the package is broken apart by bending the two package halves around said line or a part of said line e.g. 180°, whereby the two stacks are separated, each to stay in its own half, which functions as a display (see FIG. 9A, B, C). Lines 66 and 67 consist, preferably, of suitable perforations. Mere folding lines may consist of embossed grooves. The drawings also reveal several cuts as known per se delimiting various flaps.

Figure 4:
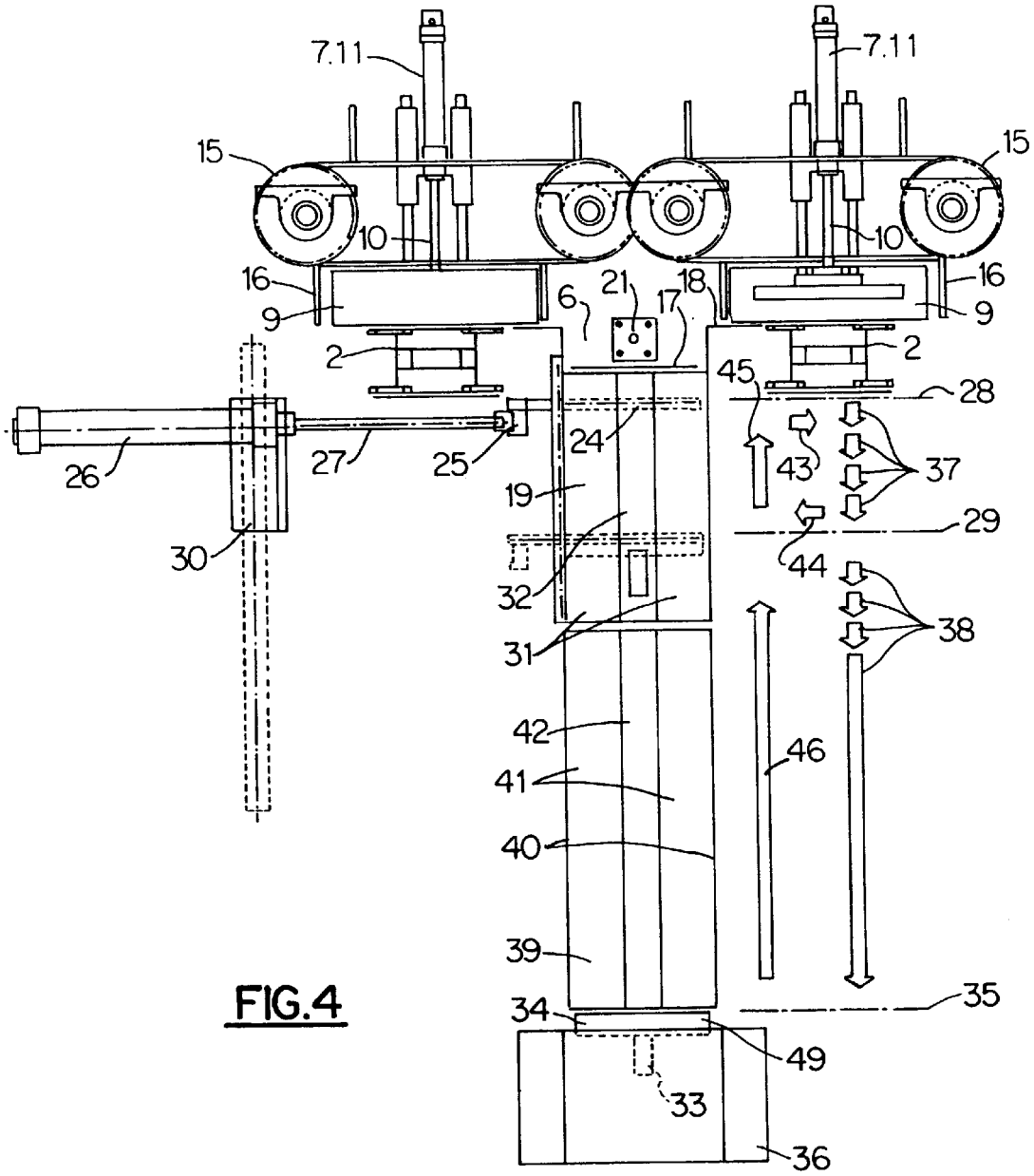
FIG. 4 is a side elevation view of the parts shown in FIG. 3.

While FIGS. 2–4 show most features in great detail, FIG. 1 shows a simplified and somewhat modified embodiment, where the upper step lift 25 may be withdrawn in a direction away from the lower step lift 34, i.e. the lower step lift extends below a double stack of articles 71 from one bottom end formation, while the upper step lift is insertable from the other bottom end formation. The receiving plates 17 each hold one article and are, preferably simultaneously, released, so that two articles overlapping each other fall down on to either a stack 72 of articles during buildup or on to the upper step lift as first articles. The purpose of the upper step lift is to receive part of a stack 72 of articles. During the time it takes to build up this part, the lower step lift is provided to move, preferably transversely, with a complete stack 72 of articles, usually two stacks, on to a carton blank 58 or to other means for holding and/or further handling. All of these features are, of course, also applicable on the arrangement shown in FIGS. 2–4 or other embodiments within the framework of this invention.

In either case, it is not mandatory to have the articles, single articles or the like overlap each other. Two stacks may also abut each other bluntly, so that even articles, packages or the like having the shape of parallelepipeds may be covered by the present invention. On the other hand, there may be up to a 100% overlap or alteration of articles of any kind. Particularly in such a case, only one receiving plate for the articles coming form both lateral conveyors may be sufficient.

The arrangement shown in FIGS. 2–4 functions as follows: On the longitudinal conveyors 2, articles 3 travel in a first direction 69 and in a second direction 70, respectively, with their bottom ends 4 first towards the receiving zone 6. Their travel is monitored by sensors 12 and computer unit 13, as mentioned before. The present invention is highly efficient allowing relatively high speeds, for instance an article per second on each conveyor, which means a packaging pace of two articles per second.

At high traveling speeds, the articles are stopped by the respective stop plate 9, and an accurate positioning of the stopped articles is often not possible. Particularly, air filled articles tend to bounce slightly backwards, and may be even slightly diagonally misaligned. The stopped articles are in this, often non-accurate, position swept from the respective longitudinal conveyor in transverse direction by the respective lateral conveyor 15 by one of its carrier plates 16 and are thrown into the upper end of duct 19 on to the respective receiving plate 17.

To remedy this problem, as mentioned before, the two receiving plates may be alternately withdrawn or simultaneously withdrawn thus dropping the articles one by one or two at a time. The dropping is not just a simple withdrawal of the plate, but also an accurate positioning manoeuver, as the article resting on its plate is drawn by the latter towards and against its positioning plate 20, whereby any space and misalignment between the article bottom 4 and plate 20, due to non-accurate feeding or whatever further reasons there may be, is eliminated, so that a very accurate mutual positioning of both article stacks is possible, usually at reduced speed, as the relatively high speed of the longitudinal conveyors partly is due to the space between the articles traveling on the longitudinal conveyor. Inaccurate mutual positioning of articles may cause either a concave depression or a convex buildup of the overlap zone of both stacks, whereby deformations, damage and even breakdowns may be caused. Such inconveniences can easily be avoided by adjusting the positioning plate 20 appropriately.

When starting to collect and stack articles, the upper step lift 25 is inserted into duct 19 at the upper level 28. For each article or each pair of overlapping articles, the lift is lowered by one step 37, until the lower level 29 is reached, where the lower step lift 34 is waiting with its platform 49. Now, the upper step lift is withdrawn transversely by step 44 and upwardly by step 45 to the upper standby position cooperating with duct 19, while the lower step lift is lowered in steps 38 down to level 35 corresponding to the place of collection/stacking of articles. When the latter level is reached, the upper step lift is pushed into duct 19 again to receive part of the articles of a stack 72 in double stack, e.g. about 4–12 articles altogether of a complete stack 72 of about 8–50 articles. At that stage, the formation holder 39 is filled with articles and will be withdrawn laterally by formation holder actuating means 47, above sliding surface 48 and on to platform 50 of transfer unit 53. Then, transfer actuating means 52 will be lifted up through guide channel 54 and into final transfer means 55 to the level of sliding surface 57, where actuating means 56 will move said transfer unit with a collected stack 72 of articles across sliding surface 57 and on to a carton blank 58, which then is e.g. sucked down into folding unit 61, i.e. where converging bars 62 will fold the blank to surround said collected stack 72 as a closed and sealed carton 63, which is fed to further handling and/or transport etc.

As soon as platform 50 has been lifted up above formation holder 38, the latter is returned by formation holder actuating means 47 to its starting position right below duct 19. Then platform 49 is lifted up again to upper level 29 awaiting receipt of a new part of stacked articles released by the upper step lift, which accordingly fills the time gap it takes for the lower step lift to complete its task and the formation holder to transfer a complete stack 72 and return to its starting position.

Figure 5:
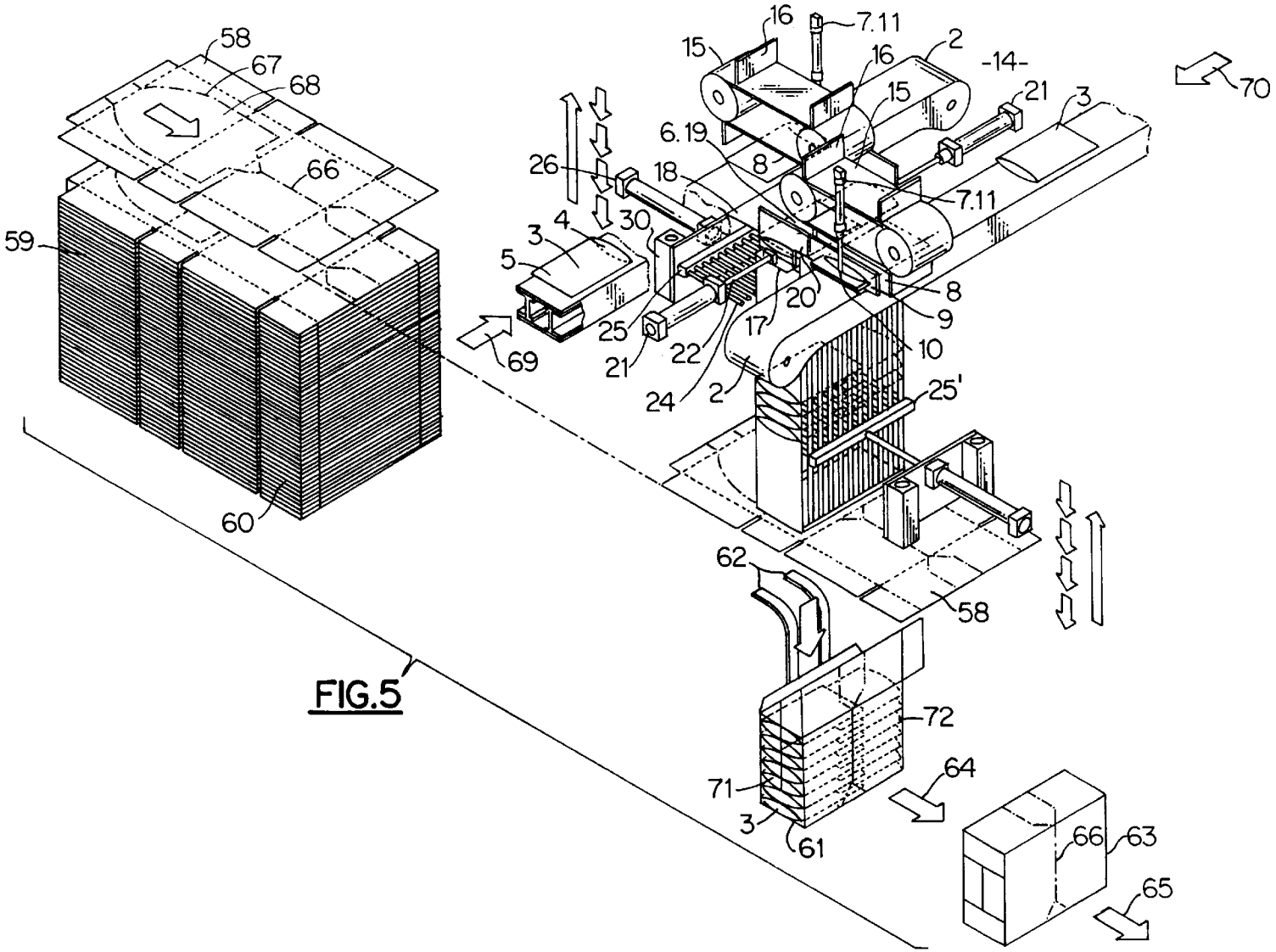
FIG. 5 shows a diagrammatic perspective view detailing a second embodiment of the present invention.

Further embodiments of the present invention detailed in FIGS. 5–8, the vertical duct 19, as defined by the angled guide plates 18, is modified to include the two sides of the duct 19 both formed with vertical slats 23. Furthermore, each of the two sides of the duct 19 are provided with one of a pair of step lifts 25, 25' having horizontal bars 24 as in the previous embodiments. These horizontal bars are insertable between the vertical slats 23 of the duct 19 and cooperatively operate such that two formations of stacked articles may be handled relatively simultaneously in a vertical alignment. As shown in FIG. 5, one of the pair of step lifts 25' is able to deliver a formation of articles directly to a packaging blank or box without any lateral transfer of the formation of articles, while the other respective step lift 25 is collecting further articles vertically above it via the longitudinal conveyor belts. It is to be appreciated that each of the step lifts both have the same function and cooperatively operate in an alternating fashion. Thus, while one step lift 25' is collecting articles the other step lift 25 delivers a full stack of articles to a packaging step and then situates itself in a stand-by position ready to begin collecting another stack of articles upon completion of collecting by the cooperating step lift.

Figure 7:
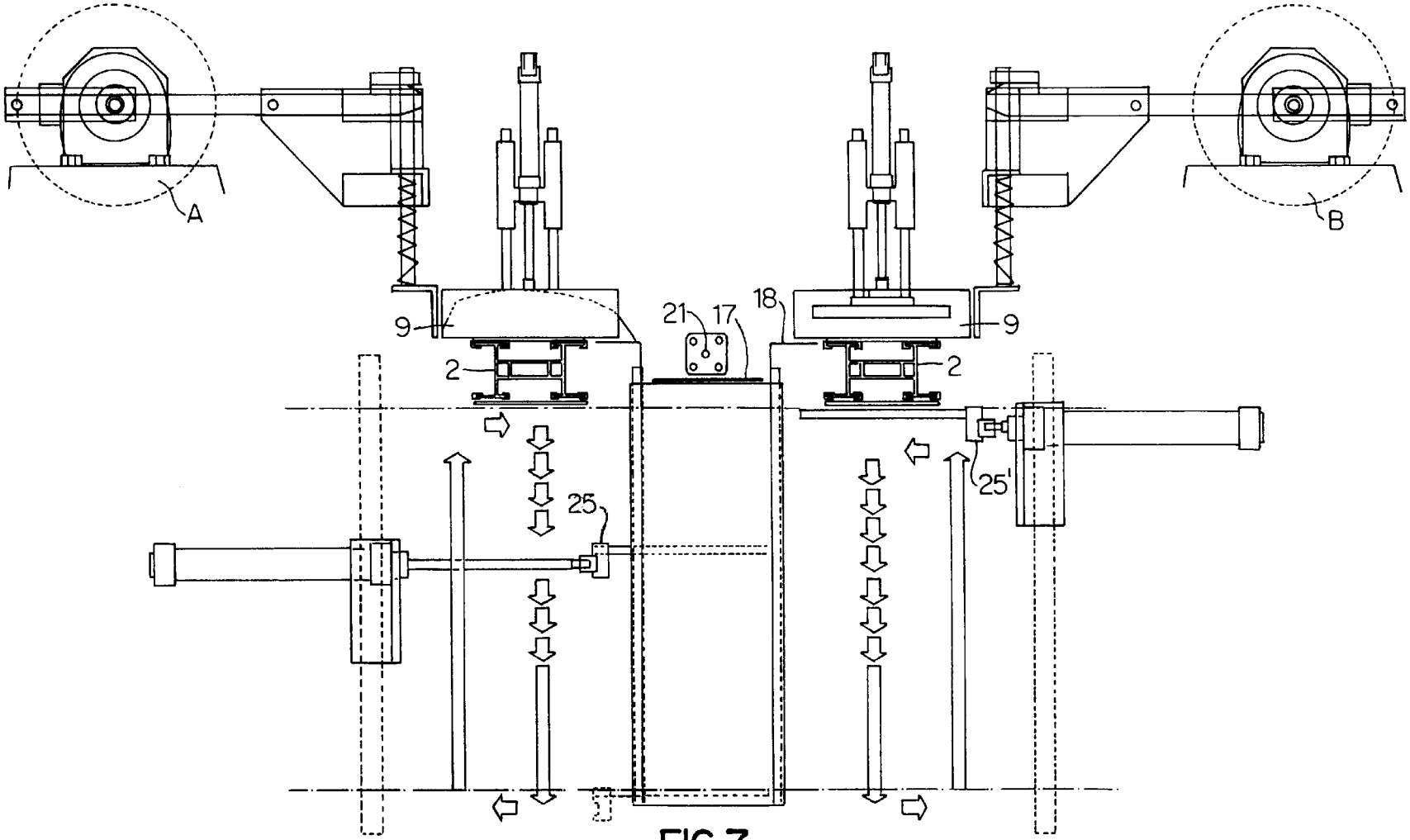
FIG. 7 shows a side elevation view of the parts as shown in FIG. 6.

To further illustrate, the embodiment shown in FIG. 5 a stack is lowered onto a wrap around package sheet or into an open box by step lift 25' while the other step lift 25 is receiving another formation and anticipating the lowering of the stack into the box or wrap around blank, the lift 25' completes delivery and goes to a standby position as shown in FIG. 7 to await its turn to collect. These steps enable an efficient and generally unbroken collection of articles and packaging of the articles by the step lifts. These complete packages may then be transferred to further handling and/or transport stations without causing any interruption in the collection or stacking and packaging of articles.

It is to be appreciated that this embodiment achieves a simplicity of function in relation to the previous embodiments by combining the first and second collecting means 25 and 34 respectively and eliminating excess maneuvering of the formations. These previous collecting means operated consecutively, collecting, moving and packaging one stack at a time, the new feature includes only one collecting means consisting of two substantially simultaneous and concurrent collection of articles. It should be noted these novel features are capable of being performed in a substantially vertical direction thus reducing the lateral space needed or footprint of the previous embodiments.

Figure 6:
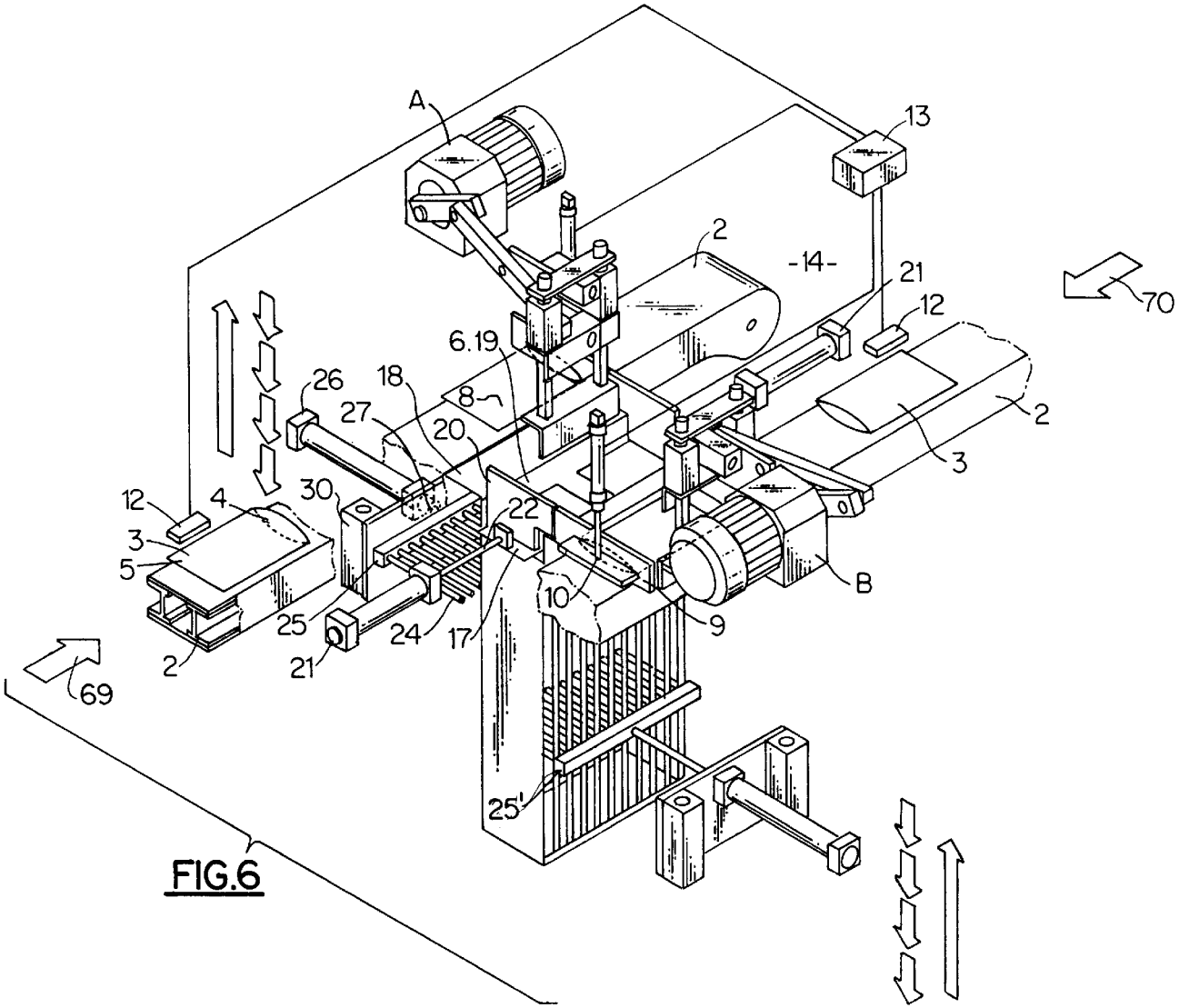
FIG. 6 shows a diagrammatic perspective view of a third embodiment of the present invention.
Figure 8:
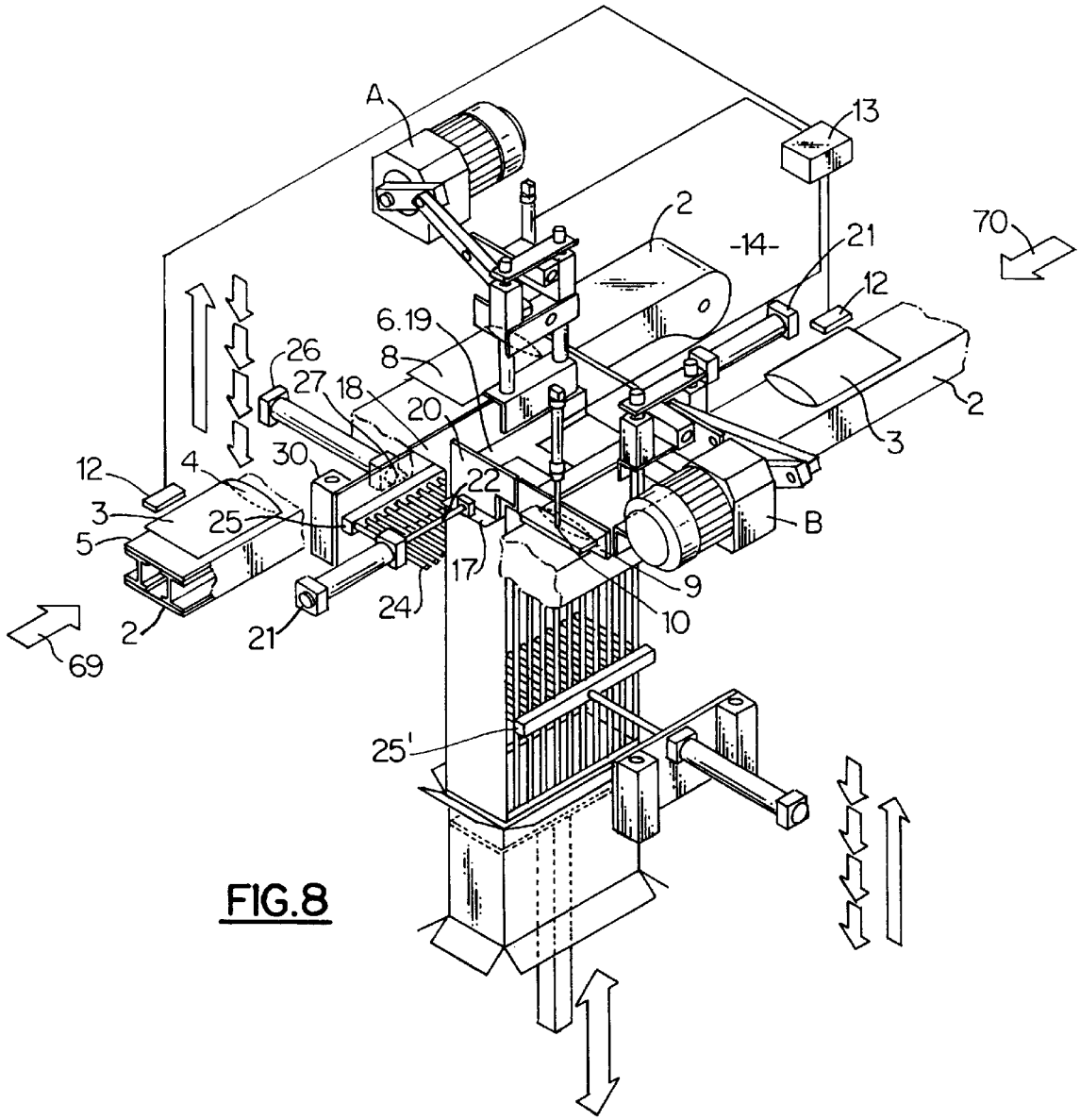
FIG. 8 shows an elaboration of FIG. 6 indicating an additional packaging step.

FIGS. 6, 7 and 8 illustrate a third embodiment of this invention, wherein the lateral conveyor belts 15, 16 are replaced by pushing mechanisms A and B, respectively. Mechanisms A and B push or sweep by means of a system of arms, an article from the respective stopping zone 8 of each longitudinal conveyor 2 to the remaining common receiving zone 6 in a horizontal movement. The pushing arms are lifted and lowered in combination with their sweeping of the article into the receiving zone in such a manner as to not interfere with an approaching article on the way back to an initial position as other articles which rapidly arrive on the longitudinal conveyor are avoided and in this way the backward movement is carried out above the approaching articles without interfering with their travel. This arrangement allows the pushing mechanisms to perform generally the same transverse horizontal sweeping of the articles from the conveyor belt and into the common receiving zone where they are positioned and stacked. However, the pushing mechanisms require considerably less space then the lateral belt conveyors 2.

The use of the pusher arms A and B, in combination with the aforementioned step lifts on either side of the duct 19 are shown in FIG. 6

All this enables high speed performance and greatest accuracy of all components.

The invention is not limited to the embodiments as described herein and shown in the accompanying drawings. Arbitrary modifications are, of course, possible within the scope of the inventive idea as outlined by the following claims. The lifts 25 and 34 may also be lowered continuously instead of stepwise.

What is claimed is:

1. An apparatus (1) for collecting, stacking and packaging a plurality of articles (3), the apparatus comprising:

first and second longitudinal conveyors (2) for carrying a plurality of articles towards a common receiving zone (6) located therebetween;

first stop means (7–11), located at a first stop zone (8) of the first longitudinal conveyor, for stopping the articles conveyed along the first longitudinal conveyor, and a first lateral conveyor (15) for laterally transferring the articles conveyed by the first longitudinal conveyor from the first stop zone (8) of the first longitudinal conveyor to the receiving zone (6);

second stop means (17–22), located at a second stop zone (8) of the second longitudinal conveyor, for stopping the articles conveyed along the second longitudinal conveyor, and a second lateral conveyor (15) for laterally transferring the articles conveyed by the second longitudinal conveyor from the second stop zone (8) of the second longitudinal conveyor to the receiving zone (6);

the first lateral conveyor (15) and the second lateral conveyor (15) being offset with respect to one another to facilitate stacking of the articles fed from the first and second longitudinal conveyors in a partially overlapped stacked formation; and collecting means for collecting the stack of articles fed from the first and second longitudinal conveyors in the partially overlapped formation.

2. The apparatus according to claim 1, wherein the first lateral conveyor (15) conveys the articles from the first longitudinal conveyor onto a first horizontal receiving plate (17) while the second lateral conveyor (15) conveys articles from the second longitudinal conveyer onto a second horizontal receiving plate (17), and both the first and second horizontal receiving plate are located adjacent the collecting means for transferring conveyed articles to the collecting means.

3. The apparatus according to claim 2, wherein the first horizontal receiving plate and the second horizontal receiving plate are retractable from the collecting means to facilitate release of an article collected thereon into the collecting means and the first horizontal receiving plate and second horizontal receiving plate are extendable back to an initial position to facilitate receiving a further article thereon once a previously collected article is deposited in the collecting means.

4. The apparatus according to claim 1, wherein the collecting means comprises a duct defined by a pair of angled guide plates, each angled guide plate has a first leg which extends in a plane defined by an upper surface of the first and second longitudinal conveyors, and a second leg which extends toward the collecting means, and the collecting means is further defined by a plurality of vertical slats and a pair of upper steps lifts, which have a grid of horizontal bars with free ends which are insertable between the vertical slats to allow transfer of articles collected in the collecting means and conveyance of the collected articles for further packaging.

5. The apparatus according to claim 1, wherein the collecting means further comprises a cooperating first and second upper step lifts (25, 25'), whereby when the first upper step lift (25) is collecting a formation (72) of articles, the second upper step lift (25') facilitates release of a previously collected formation of articles for further packaging and, thereafter, the second upper step lift (25') returns to a standby position ready to collect a further formation (72) of articles, and once the first upper step lift (25) collects a formation (72) of articles, the second upper step lift (25') is moved to a collecting position, to collect another formation (72) of articles, while the first upper step lift (25) facilitates release of the collected formation of articles for further packaging and, thereafter, the first upper step lift (25) returns to a standby position ready to collect a further formation (72) of articles.

6. The apparatus according to claim 1, wherein the first and second longitudinal conveyors (2) are located at a same horizontal level and in parallel spaced apart relationship from one other, and the first stop means (7–11) comprises a first stop plate (9) suspended from a stop actuating rod (10) and extending substantially perpendicular to a longitudinal direction of the first longitudinal conveyor (2), the second stop means (7–11) comprises a second stop plate (9) suspended from a stop actuating rod (10) and extending substantially perpendicular to a longitudinal direction of the second longitudinal conveyor (2), and a position of each of stop plates is adjustable to accommodate different sizes of articles to be stacked.

7. The apparatus according to claim 6, wherein the first stop means (7) is coupled to a first sensor (12) for detecting any misfed and misaligned articles and the first sensor (12) is coupled to a computer unit (13), and when one of a misfed and misaligned article is detected by the first sensor (12) of the first longitudinal conveyor (2), a first stop actuating means raises the first stop plate to allow the misfed and misaligned article to be conveyed by the first longitudinal conveyor (2) to a collecting zone (14) for collecting misfed and misaligned articles; and said second stop means (7) is coupled to a second sensor (12) for detecting any misfed and misaligned articles and the second sensor (12) is coupled to a computer unit (13), and when one of a misfed and misaligned article is detected by the second sensor (12) of the second longitudinal conveyor (2), a second stop actuating means raises the second stop plate to allow the misfed and misaligned article to be conveyed by the second longitudinal conveyor (2) to a collecting zone (14) for collecting misfed and misaligned articles.

8. The apparatus according to claim 6, wherein the first lateral conveyor (15) is positioned upstream of the first stop plate (9) and extends across and above the first longitudinal conveyor, and the first lateral conveyor (15) has carrier plates (16) for moving articles from the first lateral conveyor (15) towards the receiving zone (6) onto the horizontal receiving plate (17); and the second lateral conveyor (15) is positioned upstream of the second stop plate (9) and extends across and above the second longitudinal conveyor, and the second lateral conveyor (15) has carrier plates (16) for moving articles from the second lateral conveyor (15) towards the receiving zone (6) onto the horizontal receiving plate (17).

9. The apparatus according to claim 1, wherein the first and second horizontal receiving plates (17) are located at a level slightly lower than a level of an upper surface of the first and second longitudinal conveyors (2), and an angled guide plate (18) is located between the first longitudinal conveyor (2) and the first receiving plate (17) and between the second longitudinal conveyor (2) and the second receiving plate (17), each guide plate (18) has two legs, with a first leg extending substantially within a plane defined by the upper surface of the first and second longitudinal conveyors, while a second leg extends perpendicularly and defines a duct (19) for collected and stacked articles.

10. The apparatus according to claim 2, wherein a first adjustable positioning plate (20) is arranged substantially perpendicular to and cooperates with the first receiving plate (17), and the first receiving plate is movable parallel to the first longitudinal conveyor to a withdrawn position to facilitate release one at least collected article from the first receiving plate (17) to the collection means and the first receiving plate (17) is then moved back to an extended initial position to collect a next article from the first lateral conveyer (15); and a second adjustable positioning plate (20) is arranged substantially perpendicular to and cooperates with the second receiving plate (17), and the second receiving plate is movable parallel to the second longitudinal conveyor to a withdrawn position to facilitate release one at least collected article from the second receiving plate (17) to the collection means and the second receiving plate (17) is then moved back to an extended initial position to collect a next article from the second lateral conveyer (15).

11. The apparatus according to claim 5, wherein the upper step lift comprises a grid of horizontal bars (24) which have free ends and the downwardly extending leg of the angled guide plate (18) has vertical slats (23), and the free ends of the horizontal bars (24) of the upper step lift (25) are insertable between the vertical slats (23), the upper step lift is positioned adjacent the vertical slats (23) of the duct and the horizontal bars are movable between a withdrawn position and an inserted position by means of an upper step lift actuator (26), and the horizontal bars (24) forming an intermediate platform for receiving and stacking the articles, and during a collecting operation the upper step lift is provided to travel transversely into the duct and the upper step lift (25), when in an upper level engagement step (43), collects the articles, and the upper step lift progressively steps downward (37) from the upper level to a lower level as the articles are sequentially stacked thereon, and the upper step lift has a disengagement step (44), at the lower level, in which the upper step lift releases the stack of collected articles and transversely moves out of the duct and then returns vertically upward, in a single step (45), to an upper standby position to await a subsequent collecting operation.

12. The apparatus according to claim 11, wherein ends of the duct (19), remote for the first and second horizontal receiving plates (17), are partially enclosed by angled continuations (31) of the guide plates leaving a vertical slot (32) in the ends of the duct for a first bearing arm (33) of a lower collecting means (34), the lower collecting means (34) is movable in steps (38) by means of a lower step lift actuating means (36) from an upper level, coinciding with the lower level (29) of the upper step lift (25), to a second lower level (35), the steps (38) of the lower step lift are provided to continue downward motion within the duct (19) and to a formation holder (39) which has a corresponding shape to that of the duct, the formation holder (39) has lateral surfaces (40), angled continuations (41) and a slot (42) at the opposed ends, the lateral surfaces (40) are uninterrupted surfaces (40), and the lower step lift is vertically displaceable from the second lower level (35) to a standby position at the second upper level (29) in a single step (46).

13. The apparatus according to claim 12, wherein the duct (19) remains stationary, while the formation holder (39) is movable away from the upper and lower step lifts by a formation holder actuating means (47), the formation holder passes over a sliding surface (48) located between a first platform (49), carried by the first bearing arm (33), and a second platform (50) carried by a second bearing arm (51) of a transfer actuating means (52) of a transfer unit (53).

14. The apparatus according to claim 13, wherein a stationary guide channel (54), which has a corresponding shape to the formation holder (39), is located above the transfer unit (53), and a transfer means (55) is provided adjacent the guide channel (54) to collect the formation of articles.

15. The apparatus according to claim 14, wherein the transfer unit (53) is suspended from a second transfer actuating means (56) and is provided to travel above a second sliding surface (57) to maneuver the formation of articles into position on a carton blank (58), and the carton blank is fed in position from a carton stack (60) via feed means.

16. The apparatus according to claim 15, wherein the carton blank and the formation of articles positioned thereof are all move along a folding unit (61) which comprises converging bars (62), and the folding unit (61) facilitates automatic folding of the carton blank around the formation of articles to produce a folded and sealed carton (63).

17. The apparatus according to claim 16, wherein, upon commencing to collect and stack articles, the upper step lift (25) is inserted into duct (19), at the upper level (28), and the upper step lift is lowerable by one step (37), to the lower level (29) where the lower step lift (34) and the first platform (49) is waiting, and the upper step lift is withdrawn transversely from the duct and returns to the standby position adjacent to duct (19), while the lower step lift is lowerable in steps (38) to the second lower level (35), and a cyclical pace is established between the upper and lower step lift such that, when the second lower level is reached, the upper step lift is position in duct (19) to again collect a formation of articles; and the formation holder, when filled with collected articles, is maneuvered laterally by the formation holder actuating means (47), along the sliding surface (48) and onto the second platform (50) of the transfer unit (53), that the transfer actuating means (52) is provided to be lifted up through the guide channel (54) and into the final transfer means (55) on the level of the second sliding surface (57), where the second transfer actuating means (56) are provided to move the transfer unit with a collected stack (72) of articles across the second sliding surface (57) and onto a carton blank (58), which is advanced into the folding unit (61).

18. The apparatus according to claim 15, wherein once the second platform (50) is lifted by the formation holder (39), the formation holder (39) is returned by the formation holder actuating means (47) to a starting position below the duct (19), the first platform (49) is ready to be lifted again to the second upper level (29) to await receipt of the formation of acticles released by the upper step lift.

19. An apparatus (1) for collecting, stacking and packaging a plurality of articles (3), the apparatus comprising:

first and second longitudinal conveyors (2) for carrying a plurality of articles towards a common receiving zone (6) located therebetween;

first stop means (7–11), located at a first stop zone (8) of the first longitudinal conveyor, for stopping the articles conveyed along the first longitudinal conveyor, and a first lateral conveyor (15) for laterally transferring the articles conveyed by the first longitudinal conveyor from the first stop zone (8) of the first longitudinal conveyor to the receiving zone (6);

second stop means (17–22), located at a second stop zone (8) of the second longitudinal conveyor, for stopping the articles conveyed along the second longitudinal conveyor, and a second lateral conveyor (15) for laterally transferring the articles conveyed by the second longitudinal conveyor from the second stop zone (8) of the second longitudinal conveyor to the receiving zone (6);

the first lateral conveyor (15) and the second lateral conveyor (15) being offset with respect to one another to facilitate stacking of the articles fed from the first and second longitudinal conveyors in a partially overlapped stacked formation;

collecting means for collecting the stack of articles fed from the first and second longitudinal conveyors in the partially overlapped formation;

the collecting means comprising a duct defined by a pair of angled guide plates, each angled guide plate has a first leg which extends in a plane defined by an upper surface of the first and second longitudinal conveyors, and a second leg which extends toward the collecting means, and the collecting means is further defined by a plurality of vertical slats;

an upper step lift comprising a grid of horizontal bars (24) which have free ends and the free ends of the horizontal bars (24) of the upper step lift (25) are insertable between the vertical slats (23), the upper step lift is positioned adjacent the vertical slats (23) of the duct and the horizontal bars are movable between a withdrawn position and an inserted position by means of an upper step lift actuator (26), and the horizontal bars (24) forming an intermediate platform for receiving and stacking the articles, and during a collecting operation the upper step lift is provided to travel transversely into the duct and the upper step lift (25), when in an upper level engagement step (43), collects the articles, and the upper step lift progressively steps downward (37) from the upper level to a lower level as the articles are sequentially stacked thereon, and the upper step lift has a disengagement step (44), at the lower level, in which the upper step lift releases the stack of collected articles and transversely moves out of the duct and then returns vertically upward, in a single step (45), to an upper standby position to await a subsequent collecting operation.

20. A method collecting, stacking and packaging a plurality of articles (3), the method comprising the steps of:

providing first and second longitudinal conveyors (2) for carrying a plurality of articles towards a common receiving zone (6) located therebetween;

positioning first stop means (7–11), located at a first stop zone (8) of the first longitudinal conveyor, for stopping the articles conveyed along the first longitudinal conveyor, and providing a first lateral conveyor (15) for laterally transferring the articles conveyed by the first longitudinal conveyor from the first stop zone (8) of the first longitudinal conveyor to the receiving zone (6);

positioning second stop means (17–22), located at a second stop zone (8) of the second longitudinal conveyor, for stopping the articles conveyed along the second longitudinal conveyor, and providing a second lateral conveyor (15) for laterally transferring the articles conveyed by the second longitudinal conveyor from the second stop zone (8) of the second longitudinal conveyor to the receiving zone (6);

offsetting the first lateral conveyor (15) from the second lateral conveyor (15) with respect to one another to facilitate stacking of the articles fed from the first and second longitudinal conveyors in a partially overlapped stacked formation; and collecting the stack of articles fed from the first and second longitudinal conveyors in the partially overlapped formation in collecting means.

21. The method according to claims 20 further comprising the steps of stopping the article (3), in the receiving zone (6), and releasing the articles (3) to a first collecting step (25) for collecting a formation of articles, and releasing the formation of articles to a second collecting step (34) for conveying the formation of articles (72) for further handling and packaging concurrently with simultaneous collection of further formation of articles.

22. The method according to claim 20 further comprising the steps of holding the formation of articles (3) together and maneuvered the formation of articles via a transfer means (53) onto a carton blank (58) and folding the carton blank, via a folding unit (61), to form a complete package.

* * * * *